US006036150A

United States Patent [19]

Lehrman

[11] Patent Number: 6,036,150

[45] Date of Patent: Mar. 14, 2000

[54] ADJUSTABLE SHELF FOR A WASHER/ DRYER

[76] Inventor: David Lehrman, 207 Barclay Cir., Cheltenham, Pa. 19102

[21] Appl. No.: 09/004,323

[22] Filed: Jan. 7, 1998

[51] Int. Cl.[7] ..... A47G 29/02

[52] U.S. Cl. ..... 248/241; 248/235; 108/43; 211/186; 68/235 R; 68/3 R

[58] Field of Search ..... 248/235, 241, 248/244, 243; 108/158, 43, 49, 143; 211/186, 86.01; 68/235 R, 3 R

[56] References Cited

U.S. PATENT DOCUMENTS

| | | | |
|---|---|---|---|
| 2,289,523 | 7/1942 | Smallen | 126/333 |
| 2,503,132 | 4/1950 | Robinson et al. | 126/332 |
| 3,123,022 | 3/1964 | Huddleston | 108/129 |
| 3,400,829 | 9/1968 | Youngson | 211/119.6 |
| 3,917,275 | 11/1975 | Alpher | 273/136 A |
| 4,098,486 | 7/1978 | Hornsby | 248/452 |
| 4,414,959 | 11/1983 | Fair et al. | 126/332 |
| 4,507,942 | 4/1985 | Hirose et al. | 68/20 |
| 4,713,949 | 12/1987 | Wilcox | 68/235 R |
| 4,953,473 | 9/1990 | Tomaka et al. | 108/132 |
| 5,383,411 | 1/1995 | Tomaka et al. | 108/129 |
| 5,443,019 | 8/1995 | Sheldrick | 108/44 |
| 5,761,753 | 6/1998 | Talbert | 4/559 |

*Primary Examiner*—Derek J. Berger
*Assistant Examiner*—Kimberly Wood
*Attorney, Agent, or Firm*—Akin, Gump, Strauss, Hauer & Feld, L.L.P.

[57] ABSTRACT

A shelf for being positioned on a generally parallelpiped shaped appliance is provided. The appliance has a top surface and first and second side surfaces extending therefrom. The shelf includes a platform on which articles may be placed and a first leg having a first end and a second end. The first end of the first leg is connected to the platform. The second end of the first leg includes one or more interlocking members configured to securely engage one of the surfaces of the appliance. The shelf includes a second leg having a first end and a second end. The first end of the second leg is connected to the platform. The second end of the second leg includes one or more interlocking members configured to securely engage one of the surfaces of the appliance whereby the first and second legs support the platform above the top surface of the appliance.

9 Claims, 2 Drawing Sheets

ADJUSTABLE SHELF FOR A WASHER/DRYER

BACKGROUND OF THE INVENTION

The present invention relates to a support shelf and, more particularly, to an adjustable shelf for being releasably mounted on appliances, such as washers and dryers, for the purpose of storing articles of clothing and washing and drying agents.

When using clothes washers and dryers it is highly advantageous to have a co-located spot to store cleaning agents and to temporarily place clothing. Washers and dryers presently available for home and business use do not provide an adequate surface on which to place clothing or other articles when the washer and dryer are being used. In addition, washers and dryers are frequently placed in restricted places not affording suitable surfaces for storing articles. As such, users often store washing and drying agents on top of the washer/dryer control panel, a surface not designed for storing articles. This leads to the agents falling from their storage place, resulting in spillage.

There is frequently found, however, unused space just above the washers and dryers that could be utilized for storage if suitable shelving were available. However, to date, this area has only been occupied by permanent shelving which is mounted to the wall adjacent to the rear of the washer and dryer. Such shelving is difficult to install and relatively expensive.

Accordingly, there is a need for shelves which could be easily and directly mounted on washers and dryers after the washers and dryers have been installed in the home. Similarly, it would be advantageous if the shelving and/or the washers and dryers included a simple releasable interlocking mechanism for mounting the shelving on the washer or dryer. It would be further advantageous if manufacturers incorporated shelving directly into the washer and dryer design.

The present invention resulted from the inventor's observation of problems associated with the use of washers and dryers and his successful efforts to solve them. The present invention, therefore, is directed toward providing a shelf system which can be installed by a homeowner or a business person on a washer or dryer, or any other appliance having similar characteristics, with a minimum of effort or skill regardless of whether or not the appliance has been specifically designed to accept a shelving system. The invention also includes, within its scope, the ability to interconnect with appliances which have been specifically adapted to the shelving system by means of special purpose interlocking features. The invention furthermore includes within its scope, a design which can be readily incorporated into existing washer and dryer designs at the time of manufacture. The present invention fulfills a long felt need in the art by overcoming the aforementioned disadvantage of currently available appliances and provides other advantages as set forth below.

BRIEF SUMMARY OF THE INVENTION

Briefly stated, the present invention is a shelf for being positioned on a generally parallelpiped shaped appliance. The appliance has a top surface and first and second side surfaces extending therefrom. The shelf comprises a platform on which articles may be placed and includes a first leg having a first end and a second end. The first end of the first leg is connected to the platform. The second end of the first leg, includes one or more interlocking members, configured to securely engage one of the surfaces of the appliance. The shelf also includes a second leg having a first end and a second end. The first end of the second leg is connected to the platform. The second end of the second leg includes one or more interlocking members, configured to securely engage one of the surfaces of the appliance whereby the first and second legs support the platform above the top surface of the appliance.

In another aspect, the present invention is directed to a combination appliance and shelf. The appliance has a top surface and first and second side surfaces extending therefrom. A shelf is releasably attached to the appliance. The shelf includes a platform positioned above the top surface of the appliance on which articles may be placed. The shelf includes a first leg having a first end and a second end. The first end of the first leg is connected to the platform. The second end of the first leg is releasably interlocked with one of the surfaces of the appliance. The shelf includes a second leg having a first end and a second end. The first end of the second leg is connected to the platform. The second end of the second leg is releasably interlocked with one of the surfaces of the appliance whereby the first and second legs support the platform above the top surface of the appliance.

In a further aspect, the present invention is directed to a combination appliance and shelf. The appliance has a top surface and first and second side surfaces extending therefrom. A shelf is permanently secured to the appliance. The shelf includes a platform positioned above the top surface of the appliance on which articles may be placed. The shelf includes a first leg having a first end and a second end. The first end of the first leg is connected to the platform. The second end of the first leg is permanently secured to one of the surfaces of the appliance. The shelf includes a second leg having a first end and a second end. The first end of the second leg is connected to the platform. The second end of the second leg is permanently secured to one of the surfaces of the appliance whereby the first and second legs support the platform above the top surface of the appliance.

BRIEF DESCRIPTION OF THE SEVERAL VIEWS OF THE DRAWINGS

The forgoing summary, as well as the following detailed description of the presently preferred embodiment of the invention will be better understood when read in conjunction with the appended drawings. For the purpose of illustrating the invention, there is shown in the drawings, an embodiment which is presently preferred. It should be understood, however, that the present invention is not limited to the particular arrangement and instrumentality shown. In the drawings.

DETAILED DESCRIPTION OF THE INVENTION

Figure 5:
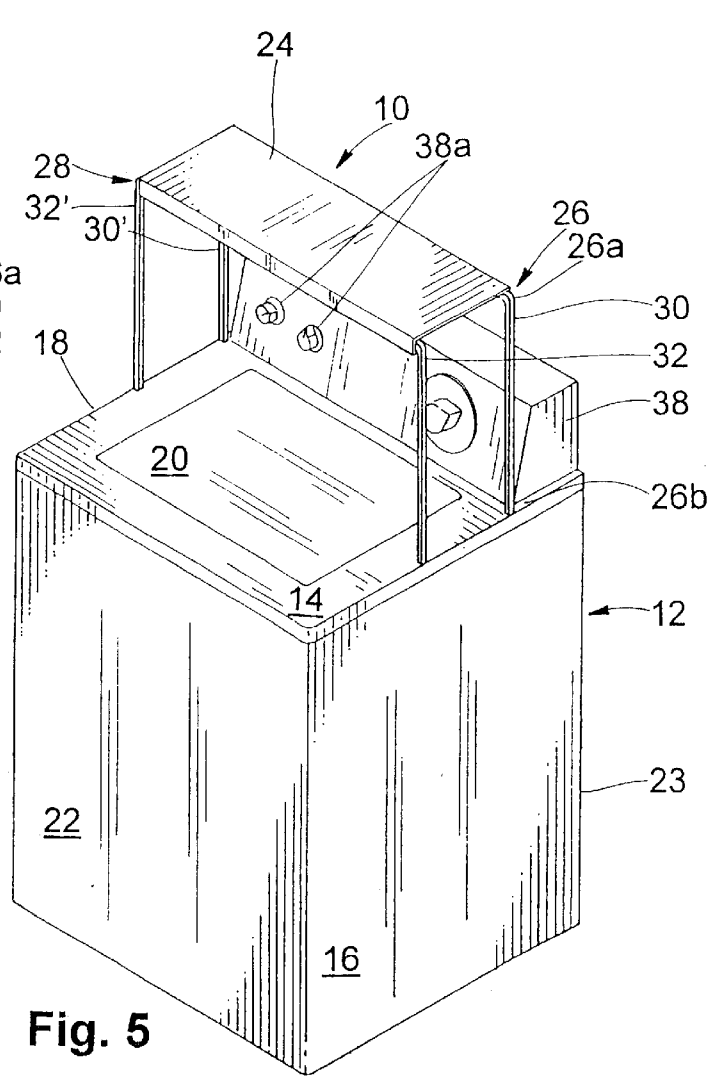
FIG. 5 is a perspective view of a shelf permanently mounted on an appliance in accordance with a second preferred embodiment of the invention.

Certain terminology is used in the following description for convenience only and is not limiting. The words "right,"

"left," "lower," "upper," "forward" and "rearward" designate directions in the drawings to which reference is made. The words "inwardly" and "outwardly" refer to directions toward and away from, respectively, the geometric center of the shelf or appliance and designated parts thereof. The terminology includes the words above specifically mentioned, derivatives thereof and words of similar import.

Figure 1:
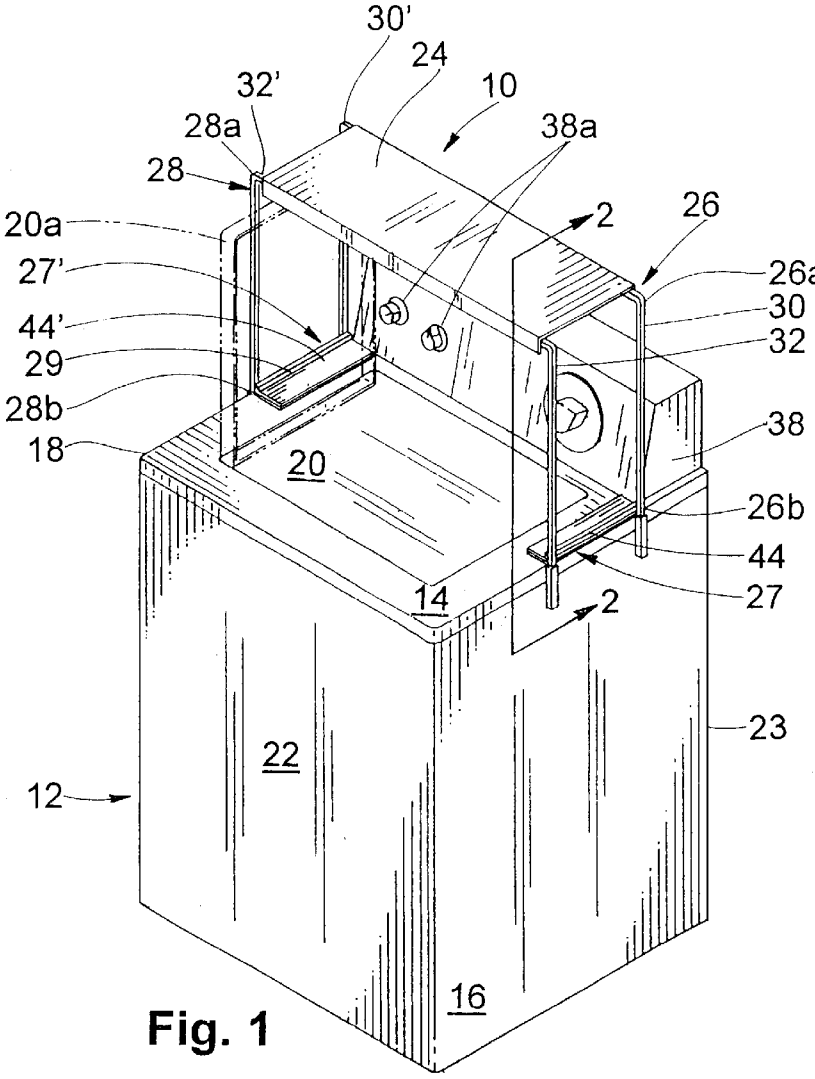
FIG. 1 is a perspective view of the shelf releasably mounted on a typical appliance in accordance a first preferred embodiment of the invention.

Referring to the drawings in detail, where like numerals indicate like elements throughout, there is shown in FIGS. 1 through 4, a first preferred embodiment of a shelf 10 positioned on a generally parallelpiped shaped appliance 12. Referring now to FIG. 1, the appliance 12 has a top surface 14 and first and second side surfaces 16, 18 extending therefrom. In the present invention, it is preferred that the appliance 12 be a standard laundering type appliance, such as a washer or dryer. However, it is understood by those of ordinary skill in the art from this disclosure, that the present invention is not limited to any particular type of appliance and that the invention could be employed with other appliances such as stoves, basins, dishwashers, or other utilitarian machines used in the home or business.

As shown in FIG. 1, the appliance 12 also includes front and rear surfaces 22, 23 extending downwardly from the top surface 14 between the first and second side surfaces 16, 18. A raised operating or control panel 38 extends upwardly from the back edge of the top surface 14 of the appliance 12. The control panel 38 includes standard control knobs 38*a* for controlling the various functions of the appliance 12, as is well understood by those of ordinary skill in the art.

As mentioned previously, the appliance 12 is generally in the form of parallelpiped. However, it is understood by those of ordinary skill in the art that the present invention is not limited to an appliance of any particular shape. For instance, the appliance 12 could be generally cylindrical, without departing from the spirit and scope of the of the invention.

The appliance 12 includes a pivotally mounted door 20 having a terminal end 20*a*. The door 20 is hingedly connected to the top surface 14 of the appliance 12 and is pivotable between a first or closed position (shown in solid lines in FIG. 1), where the door 20 is generally planar with the top surface 14, and a second or open position (shown in phantom in FIG. 1), where the door 20 is generally perpendicular with respect with the top surface 14, to allow access to the interior of the appliance 12. Washers with such door constructions are understood by those of ordinary skill in the art as being commonly referred to as top-loading washers. It is also understood by those of ordinary skill in the art that the present invention is not limited to appliances having doors mounted on the top surface thereof and that door can be mounted, for instance, on the front surface 22 of the appliance 12 (not shown).

In the present invention, it is preferred that the shelf 10 be adjustable to accommodate different size appliances, in a manner described in more detail hereinafter. In the first preferred embodiment shown in FIG. 1, the shelf 10 is preferably releasably attached to the appliance 12, although it is also understood by those of ordinary skill in the art from this disclosure that the shelf 10 could be permanently attached to the appliance 12, as shown in the second preferred embodiment of FIG. 5 and as described in more detail hereinafter.

Since the first preferred embodiment of the shelf 10 is preferably used in the laundry field, it is constructed of a durable material which is capable of withstanding the caustic attributes of cleaning materials, such as laundry detergents. Accordingly, in the first preferred embodiment of the invention, the shelf 10 is constructed of any combination of metal, plastic or other rigid, self-supporting materials which are capable of withstanding caustic type laundry detergents, except as indicated otherwise herein. However, it is understood by those of ordinary skill in the art that the various elements of the shelf 10 can be fabricated with other materials such as wood, or of more than one material, without departing from the spirit and scope of the invention.

As shown in FIG. 1, the shelf 10 includes a platform 24 on which articles (not shown) may be placed. While it is preferred that the platform 24 be of approximately the same width as the appliance 12 it is understood by those skilled in the art from this disclosure that the platform 24 could be of either greater or lesser invention. The platform 24 has a depth approximately equal to one third the depth of the appliance 12. However, it is understood by those skilled in the art from this disclosure that the present invention is not limited to any particular platform 24 depth. For instance, the depth of the platform 24 could extend between the front and rear surfaces 22, 23 of the appliance 12, without departing from the spirit and scope of the invention.

In the first preferred embodiment, the platform 24 is generally U-shaped in cross-section and is of single piece construction to provide the platform 24 with structural rigidity. However, it is understood by those skilled in the art from this disclosure that the platform 24 may be of multiple piece construction and be differently shaped, such as generally rectangular in cross-section. Moreover, the ends of the platform 24 proximate the first and second side surfaces 16, 18 could include a downwardly extending flange (not shown) to further provide the platform 24 with structural rigidity. The platform 24 can be adjusted in width or depth, thereby, making the platform 24 adaptable to various size appliances and various articles (not shown). For instance, the platform 24 can be constructed of two pieces which are channeled to permit the pieces to expand the width of the platform.

Referring now to FIG. 1, the platform 24 is shown positioned above the top surface 14 of the appliance 12 a predetermined distance, such that the terminal end 20*a* of the appliance door 20 is located between the top surface 14 of the appliance 12 and the platform 24 when the door 20 is in the second or open position. It is understood by those skilled in the art that the predetermined distance of the platform 24 above the top surface 14 is limited only by way of not interfering with appliance constituents, such as the door 20, the control knobs 38*a* and a dryer filter (not shown). In the first preferred embodiment the platform 24 is mounted just forward of the control panel 38. It is understood by those skilled in the art from this disclosure that the platform 24 can be mounted anywhere on the top or side surfaces 14, 16, 18 of the appliance 12, either forward of its shown position or to the rear of its shown position depending upon the specific nature of the appliance upon which it is mounted or that of the surrounding obstacles, without departing from the spirit and scope of the invention.

Referring now to FIGS. 1–4, the shelf 10 includes a first leg 26 having a first end 26*a* and a second end 26*b*. The first end 26*a* of the first leg 26 is connected to the platform 24. The second end 26*b* of the first leg 26 includes one or more interlocking members, generally designated 27, configured to securely engage at least one of the top and first side surfaces 14, 16 of the appliance 12. In the first preferred embodiment, the first leg 26 includes first and second side legs 30, 32, respectively, which are generally square in cross section and generally "L" shaped. The first and second side legs 30, 32 each include first and second ends 30*a*, 30*b*, 32*a*, 32*b*, respectively, which correspond to the first and second ends 26*a*, 26*b* of the first leg 26. The first and second side legs 30, 32 also include terminal ends 30*c*, 32*c*, extending from the second ends 30*b*, 32*b* for gripping the appliance 12 first and second side surfaces 14, 16. A cross bar 29 extends between the second ends 30*b*, 32*b* of the first and second side legs 30, 32 to provide the first leg 26 with structural integrity. The cross bar 29 is preferably welded to the second ends 30*b*, 32*b* of the first and second side legs 30, 32. However, it is understood by those of ordinary skill in the art from this disclosure that the cross bar 29 could be secured to the first and second side legs 30, 32 in other manners, such as with standard fasteners (not shown).

It is understood by those skilled in the art that the side legs 30, 32 may be of rectangular, circular or any convenient cross-section, may be hollow or solid, may be of any material suitable in strength and rigidity for supporting the platform 24 and the articles resting upon it, and of any shape which suitably interfaces the platform 24 with the top surface 14 of the appliance 12, without departing from the spirit and scope of the invention. Furthermore, while in the first preferred embodiment, the first leg 26 is comprised of a first side leg 30 and a second side leg 32 it is understood by those skilled in the art from this disclosure that the first leg 26 need not comprise two side legs but may be of any number of legs, including a single leg constructed of solid or composite material, without departing from the spirit and scope of the invention.

Figure 2:
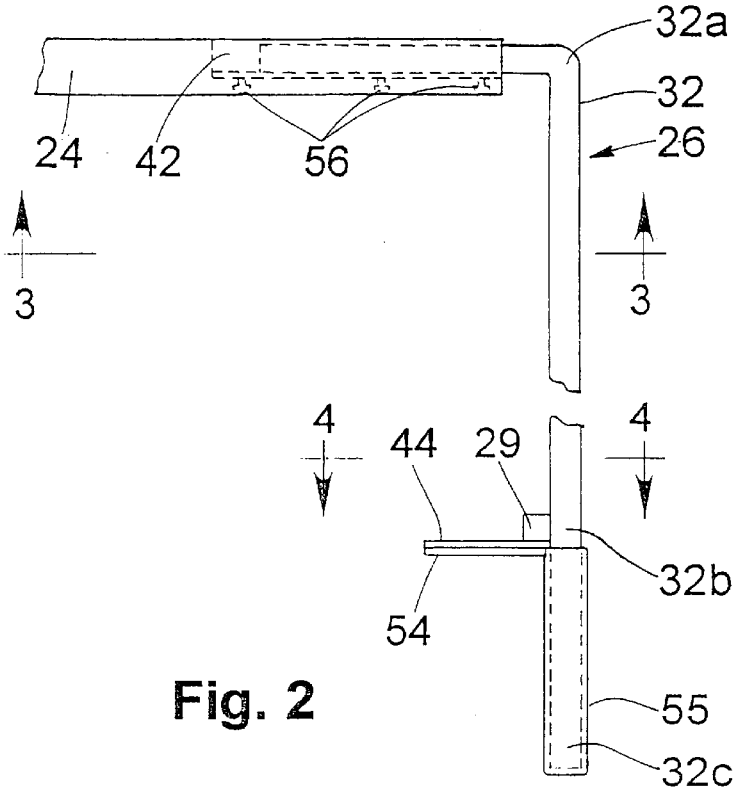
FIG. 2 is an enlarged front elevational view of a portion of the shelf taken along the line 2—2 FIG. 1.
Figure 3:
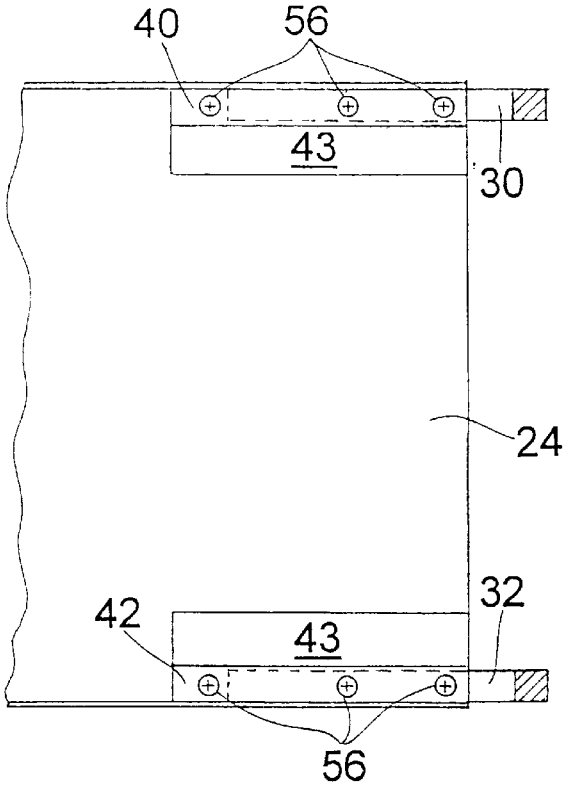
FIG. 3 is a cross-sectional view of the shelf shown in FIG. 2 taken along line 3—3 of FIG. 2.

Referring now to FIGS. 2 and 3, in the first preferred embodiment, a portion of the first end 30*a* of the first side leg 30 of the first leg 26 and a portion of the first end 32*a* of the second side leg 32 of the first leg 26 are slidably disposed within a first channel 40 and a second channel 42, respectively, located on the underside of the platform 24. The fit of the first ends 30*a*, 32*a* of the first side leg 30 and second side leg 32 into the first and second channels 40, 42 is such that the first and second side legs 30, 32 may be easily adjusted to the extent of their penetration into the first and second channels 40, 42. The first and second channels 40, 42 each have one or more set screws 56, and preferably three, threadably received therein for the purpose of securing the first end 30*a* of the first side leg 30 of the first leg 26 and the first end 32*a* of the second side leg 32 of the first leg 26 in a selected position within the respective channels 40, 42. This permits adjustment of the width of the shelf 10 as described in more detail hereinafter. While in the first preferred embodiment the first and second ends 30*a*, 32*a* are secured in position by set screws 56, it is understood by those skilled in the art from this disclosure that other mechanisms, such as a ratchet, may be employed for securing the first and second ends 30*a*, 32*a* without departing from the spirit and scope of the invention.

The first and second channels 40, 42 are preferably welded to the underside of the platform 24 by welding a securing flange 43 extending from the first and second channels 40, 42 thereto. However, the first and second channels could be secured to the platform 24 in other manners, such as by standard fasteners (not shown) or may be integrally formed as part of the platform 24.

As mentioned above, the second end 26*b* of the first leg 26 includes one or more interlocking members 27 configured to securely engage one of the surfaces of the appliance 12. In the first preferred embodiment, the first leg 26 includes a first flange 44, adjacent to and extending from the second end 26*b* of the first leg 26 for being in contact with the top surface 14 of the appliance 12. More particularly, the flange 44 extends between the second ends 30*b*, 32*b* of the first and second side legs 30, 32 of the first leg 26. The flange 44 is preferably positioned a short distance from the terminal end 30*c*, 32*c* of the second ends 30*b*, 32*b* of the first and second side legs 30, 32 of the first leg 26 such that the terminal ends 30*c*, 32*c* engage the first side surface 16 of the appliance 12. Thus, the flange 44 and terminal ends 30*c*, 32*c* combine to interlock the first leg 26 to the appliance 12.

In the first preferred embodiment, the flange 44 is shown as being the same approximate width as the distance between the first and second side legs 30, 32 of the first leg 26. It is understood by those skilled in the art that the width and depth of the flange 44 are limited only by potential obstructions on the appliance 12. However, the width of the flange 44 is made large enough to provide for maximum shelf stability. While in the first preferred embodiment it is preferred that the interlocking member 27 be a combination of the flange 44 and terminal ends 30*c*, 32*c*, it is understood by those skilled in the art from this disclosure that other types of interlocking members or supporting structures may be used for being in supporting contact with the top and side surfaces 14, 16, 18 of the appliance 12 without departing from the spirit and scope of the invention. For instance, self taping screws (not shown) could be used to releasably secure the first leg 26 to the appliance 12. Similarly, the flange 44 could be omitted and the terminal ends 30*c*, 32*c* could be located in suitably sized apertures (not shown) in the appliance 12.

Referring now to FIG. 2, the first flange 44 is at least partially covered with a cushioning material 54 located to protect the appliance 12. The cushioning material 54 preferably extends along the entire under side of the flange 44. The cushioning material 54 may be of any soft material capable of withstanding the rigors of the caustic environment and capable of being bonded to the flange 44 by either adhesive backing or by separate application of adhesive. Polyethylene foarn, polyvinyl foam, felt, or rubber are suitable cushioning materials. It is understood by those skilled in the art that the cushioning material can be other than that specifically named without departing from the spirit or scope of the invention.

Figure 4:
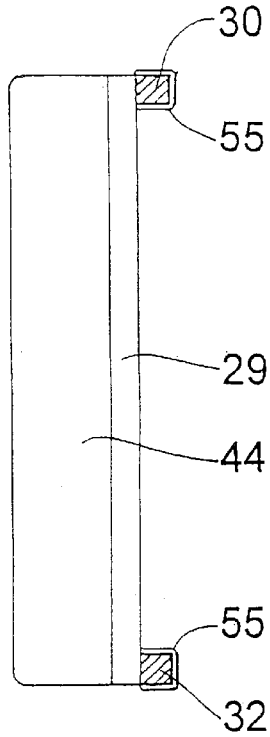
FIG. 4 is a cross-sectional view of the shelf shown in FIG. 2 taken along line 4—4 of FIG. 2.

Referring now to FIGS. 2 and 4, there is shown a cushioning material 55, generally identical to cushioning material 54 on the flange 44, covering the terminal ends 30*c*, 32*c* of the second ends 30*b*, 32*b* of the first and second side legs 30, 32 for the purpose of protecting the appliance 12.

Referring now to FIG. 1, in the first preferred embodiment there is a second leg 28 having a first end 28*a* connected to the platform 24 and a second end 28*b* including one or more interlocking members, generally designated 27', configured to securely engage at least one of the top and second side surfaces 14, 18 of the appliance 12. The second leg 28 is of like material, construction and assembly as the first leg 26. Accordingly, like reference numerals having a prime symbol thereafter are used in the drawings to designate like elements. According, for purposes of convenience and brevity only, a complete description and separated detailed drawing of the second leg 28 is omitted.

As shown in FIG. 1, the first leg 26 and the second leg 28 together support the platform 24 above the top surface 14 of the appliance 12. The first and second legs 26, 28 are spaced apart a distance, the distance being adjustable to accommodate different size appliances. In the first preferred embodiment, the first leg 26 is adjusted by positioning the first leg 26 with respect to the platform 24 by sliding the first ends 30*a*, 32*a* of the first and second side legs 30, 32 within the first and second channels 40, 42 to the desired position and then tightening the set screws 56. The same procedure is then carried out in connection with the second leg 28. In the first preferred embodiment the distance between the first and second legs 26, 28 is determined by adjusting the positions of the first and second legs 26, 28. However, where the shelf has been suitably manufactured, such that the platform 24 itself is adjustable in width as previously discussed, the distance between the first and second legs 26, 28 may be adjusted by adjusting the platform 24 width, without departing from the spirit and scope of the invention.

In use, the first preferred embodiment of shelf 10 is attached to the appliance 12 by the following steps: (1) loosening the set screws 56; (2) adjusting the first and second legs 26, 28 such that the distance between the first and second legs 26, 28 is just slightly greater than the width of the appliance 12; (3) setting the shelf 10 on the appliance 12 by resting the first and second flanges 44, 44' on the top surface 14 of the appliance 12; (4) sliding the first and second legs 26, 28 toward each other so that the interlocking members 27, 27' contact the top surface 14 and side surfaces 16, 18 of the appliance 12; (5) tightening the set screws 56; (6) removing the shelf 10 from the appliance 12; (7) turning the shelf 10 upside down and loosing the set screws 56; (8) sliding the first leg 26 toward the second leg 28 by approximately 1/16th inch; (9) tightening the set screws 56; and (10) placing the shelf 10 on the appliance 12 and concurrently applying a slight outward force to the first and second legs 26, 28 to spread the first and second legs 26, 28 apart so that upon setting the shelf 10 on the appliance, the interlocking members 27, 27' exert a pressure on the appliance first and second side surfaces 16, 18 by the natural elastic restoring forces of the first and second legs 26, 28 thus stabilizing the shelf 10 on the appliance 12. It is understood by those skilled in the art that other procedures for attaching the shelf 10 to the appliance 12 may be employed, for instance, the appliance width could be measured with a rule and the distance between the first and second legs 26, 28 secured before setting the shelf 10 on the appliance 12.

Referring now to FIG. 5, in a second preferred embodiment of the invention the second end **26*b* of the first leg 26 and the second end 28*b* of the second leg 28 are secured to the appliance 12 and platform 24 either permanently such as by welding (as shown in FIG. 5), or riveting (not shown) or semi-permanently, such as with screws and nuts (not shown). It is understood by those skilled in the art that the means for securing the first and second legs 26, 28 to the appliance 12 could be selected consistent with the manufacturing methods of the appliance 12. Accordingly, the shelf 10 in accordance with the second preferred embodiment is not adjustable in width. Otherwise the shelf 10 in accordance with the second preferred embodiment is identical to the first preferred embodiment and, therefore, like elements are used in FIGS. 1 and 5** to identify like elements throughout, without a repeat of the foregoing description, for purposes of convenience and brevity only.

From the foregoing description, it can be seen that the present invention comprises a shelf suitable for mounting on a wide variety of appliances found commonly in homes and businesses. It will appreciated by those skilled in the art that the changes and modifications may be made to the above described embodiment without departing from the inventive concept thereof. It is understood therefore that the present invention is not limited to the particular embodiment disclosed but is intended to include all modifications and changes which are within the scope and spirit of the invention as defined by the appended claims.

I claim:

1. A combination appliance and shelf comprising:

(a) an appliance having a top surface, first and second side surfaces extending therefrom and a door having a terminal end, the door being hingedly connected to the top surface of the appliance and pivotable between a first portion, wherein the door is generally planar with the top surface, and a second portion, wherein the door is generally perpendicular with respect to the top surface;

(b) a shelf releasably attached to the appliance comprising:

(i) a platform of fixed surface area having an underside and a support surface positioned above the top surface of the appliance on which articles may be place the terminal end of the door being located between the top surface of the appliance and the platform when the door is in the second position;

(ii) a first leg having end and a second end, the first end of the first being adjustably connected along the underside of the platform, the second end of the first leg being releasably interlocked with one of the surfaces of the appliance; and (iii) a second leg having a first end and a second end, the first end of the second leg being adjustably connected along the underside of the platform, the second end of the first and second legs being located in the first plane, the first plane extending generally parallel to the platform, the second end of the first and second legs being releasably interlocked with one of the surfaces of the appliance in the first plane.

2.The combination of claim 1 wherein the shelf is constructed of any combination of metal, plastic or other rigid, self supporting materials.

3. The combination of claim 1 wherein the shelf is adjustable to accommodate different size appliances.

4. A combination appliance and shelf comprising:

(a) an appliance having a top surface and first and second side surfaces extending therefrom;

(b) a shelf releasably attached to the appliance comprising:

(i) a platform of fixed surface area having an underside and a support surface positioned above the top surface of the appliance on which articles may be placed, the platform including first and second channels alone the underside of the platform;

(ii) a first leg having a first end and a second end, the first end of the first leg having a portion which is slidably disposed within the first channel along the underside of the platform, the second end of the first leg being releasably interlocked with one of the surfaces of the appliance; and (iii) a second leg having a first end and a second end, the first end of the second leg having a portion which is slidably disposed within the second channel along the underside of the platform, the second end of the first and second legs being located in a first plane, the first plane extending generally parallel to the platform, the second end of the first and second legs being releasably interlocked with one of the surfaces of the appliance in the first plane, the first and second legs being spaced apart at a distance, the distance being adjustable to accommodate different sized appliances, each channel threadably receiving a set screw to secure the portion of the first and second legs within respective channels.

5. A combination appliance and shelf comprising:

(a) an appliance having a top surface and first and second side surfaces extending therefrom;

(b) a shelf attached to the appliance comprising:

(i) a platform of fixed surface area having an underside and a support surface positioned above the top surface of the appliance on which articles may be placed, the platform including first and second channels along the underside of the platform;

(ii) a first leg having a first end and a second end, the first end of the first leg having a portion which is slidably disposed within the first channel, the second end of the first leg being secured to the appliance; and (iii) a second leg having a first end and a second end, the first end of the second leg having a portion which is slidably disposed within the second channel, the second end of the first and second legs being located in a first plane, the first plane extending generally parallel to the platform, the second end of the first and second legs being secured to the appliance in the first plane, each channel threadably receiving a set screw to secure the portion of the first and second legs within respective channels.

6. The combination of claim 5 wherein the appliance further includes a door having a terminal end, the door being hingedly connected to the top surface of the appliance and pivotable between a first position, wherein the door is generally planar with the top surface, and a second position, wherein the door is generally perpendicular with respect to the top surface, whereby the terminal end of the door is located between the top surface of the appliance and the platform when the door is in the second position.

7. The combination of claim 5 wherein the shelf is constructed of any combination of metal, plastic or other rigid, self supporting materials.

8. The combination of claim 5 wherein the shelf is adjustable to accommodate different size appliances.

9. The combination of claim 5 wherein the second ends of the first and second legs are integral with the appliance.

* * * * *